US011434098B2

(12) United States Patent
Hojo et al.

(10) Patent No.: US 11,434,098 B2
(45) Date of Patent: Sep. 6, 2022

(54) SHEET SORTING DEVICE AND IMAGE FORMING APPARATUS

(71) Applicant: CANON KABUSHIKI KAISHA, Tokyo (JP)

(72) Inventors: Yuta Hojo, Suntou-gun (JP); Genki Takahashi, Mishima (JP); Kazuhisa Sato, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/210,517

(22) Filed: Dec. 5, 2018

(65) Prior Publication Data

US 2019/0193981 A1 Jun. 27, 2019

(30) Foreign Application Priority Data

Dec. 22, 2017 (JP) ..... JP2017-246679

(51) Int. Cl.
*B65H 31/24* (2006.01)
*B65H 43/02* (2006.01)
(Continued)

(52) U.S. Cl.
CPC ..... *B65H 31/24* (2013.01); *B65H 31/02* (2013.01); *B65H 31/22* (2013.01); *B65H 33/08* (2013.01); *B65H 43/02* (2013.01); *G03G 15/6538* (2013.01); *B65H 2301/4212* (2013.01); *B65H 2405/10* (2013.01); *B65H 2405/11151* (2013.01); *B65H 2405/332* (2013.01);
(Continued)

(58) Field of Classification Search
CPC ... B65H 31/24; B65H 31/22; B65H 2405/332
See application file for complete search history.

(56) References Cited

U.S. PATENT DOCUMENTS 6,246,926 B1 * 6/2001 Ishii ..... B65H 39/11 270/58.18
6,515,735 B2 * 2/2003 Takoh ..... B65H 31/22 271/278
(Continued)

FOREIGN PATENT DOCUMENTS

CN 1361502 A 7/2002
JP H08198515 A 8/1996
(Continued)

*Primary Examiner* — Patrick Cicchino
(74) *Attorney, Agent, or Firm* — Canon U.S.A., Inc. I.P. Division

(57) ABSTRACT

A sheet sorting device includes three or more trays including a predetermined tray detachable from an apparatus main body and a tray different from the predetermined tray, a discharge unit to discharge a sheet to any one of the three or more trays, a control unit, and a tray detection unit to detect that the predetermined tray is detached from the apparatus main body. The control unit sets a sheet discharge destination such that a sheet conforming to a preset condition is discharged to the predetermined tray through the discharge unit. Where the tray detection unit detects that the predetermined tray is detached from the apparatus main body, the control unit sets a sheet discharge destination that has been set to the predetermined tray to the tray different from the predetermined tray based on a state of each of the trays other than the detached predetermined tray.

4 Claims, 8 Drawing Sheets

(51) Int. Cl.

| | |
|---|---|
| ***B65H 31/22*** | (2006.01) |
| ***G03G 15/00*** | (2006.01) |
| ***B65H 33/08*** | (2006.01) |
| ***B65H 31/02*** | (2006.01) |

(52) U.S. Cl.
CPC ..... *B65H 2408/11* (2013.01); *B65H 2408/111* (2013.01); *B65H 2511/30* (2013.01); *B65H 2511/51* (2013.01); *B65H 2511/515* (2013.01); *B65H 2513/42* (2013.01); *B65H 2801/06* (2013.01)

(56) References Cited

U.S. PATENT DOCUMENTS

| | | | | |
|---|---|---|---|---|
| 9,050,846 | B2 * | 6/2015 | Riper | B42C 1/125 |
| 9,611,120 | B2 * | 4/2017 | Suzuki | B65H 31/02 |
| 2002/0118351 | A1 | 8/2002 | Takoh | |
| 2006/0244208 | A1 * | 11/2006 | Kubota | B65H 31/22 271/207 |
| 2014/0297024 | A1 | 10/2014 | Riper | |

FOREIGN PATENT DOCUMENTS

| | | | |
|---|---|---|---|
| JP | 9-86783 | A | 3/1997 |
| JP | 2000-44105 | A | 2/2000 |
| JP | 2000-086078 | A | 3/2000 |
| JP | 2003-054830 | A | 2/2003 |
| JP | 2006-151668 | A | 6/2006 |
| JP | 2009-126598 | A | 6/2009 |

* cited by examiner

FIG.5

(A-1)

| DISCHARGE TRAY | SORTING CONDITION | USE HISTORY |
|---|---|---|
| 210 | USER A | YES |
| 211 | USER B | NO |
| 212 | USER C | NO |

(A-2)

| DISCHARGE TRAY | SORTING CONDITION | USE HISTORY |
|---|---|---|
| 210 | USER A | YES |
| 211 | USER B | NO |
| 212 | USER C<br>○ USER B | NO |

(B-1)

| DISCHARGE TRAY | SORTING CONDITION | REMAINING NUMBER OF STACKABLE SHEETS |
|---|---|---|
| 210 | USER A | 120 |
| 211 | USER B | 200 |
| 212 | USER C | 200 |

(B-2)

| DISCHARGE TRAY | SORTING CONDITION | REMAINING NUMBER OF STACKABLE SHEETS |
|---|---|---|
| 210 | USER A<br>○ USER B | 120 |
| 211 | USER B | 200 |
| 212 | USER C | 30 |

(C-1)

| DISCHARGE TRAY | SORTING CONDITION | USE HISTORY/ FUNCTION |
|---|---|---|
| 210 | USER A | YES/WITH OFFSET |
| 211 | USER B | YES/WITHOUT OFFSET |
| 212 | USER C | YES/WITHOUT OFFSET |

(C-2)

| DISCHARGE TRAY | SORTING CONDITION | USE HISTORY/ FUNCTION |
|---|---|---|
| 210 | USER A<br>○ USER B | YES/WITH OFFSET |
| 211 | USER B | YES/WITHOUT OFFSET |
| 212 | USER C | YES/WITHOUT OFFSET |

SHEET SORTING DEVICE AND IMAGE FORMING APPARATUS

BACKGROUND OF THE INVENTION

Field of the Invention

The present disclosure relates to a sheet sorting device having a plurality of discharge trays including a detachable discharge tray and an image forming apparatus.

Description of the Related Art

Conventionally, there has been provided an image forming apparatus including a sheet sorting device having a plurality of discharge trays. For example, the sheet sorting device discharges sheets to a different discharge tray at each user to sort the sheets.

Japanese Patent Application Laid-Open No. 2000-44105 discusses a sheet sorting device having a plurality of discharge trays attachable/detachable to/from an apparatus main body. For example, if the first tray of the plurality of discharge trays is detached, a sheet stacking space of the second tray arranged on the lower side of the first tray is increased, so that a maximum number of sheets stackable on the second tray can be increased.

However, Japanese Patent Application Laid-Open No. 2000-44105 does not describe the control to be executed when the first tray is detached in a state where a sheet discharge destination is set such that a sheet conforming to a preset condition is sorted to the first tray. For example, a sorting destination of the sheet is not described with respect to the case where the first tray is detached in a state where a discharge destination of the sheet printed according to the printing instruction of the first user is set as the first tray.

SUMMARY OF THE INVENTION

The present disclosure is directed to a technique for refining usability when a discharge tray is detached from an apparatus main body.

According to an aspect of the present disclosure, a sheet sorting device includes three or more trays including a predetermined tray detachable from an apparatus main body and a tray different from the predetermined tray, a discharge unit configured to discharge a sheet to any one of the three or more trays, a control unit configured to set a sheet discharge destination such that a sheet conforming to a preset condition is discharged to the predetermined tray through the discharge unit, and a tray detection unit configured to detect that the predetermined tray is detached from the apparatus main body, wherein, in a case where the tray detection unit detects that the predetermined tray is detached from the apparatus main body, the control unit sets a sheet discharge destination that has been set to the predetermined tray to the tray different from the predetermined tray based on a state of each of the trays other than the detached predetermined tray.

Further features of the present disclosure will become apparent from the following description of embodiments with reference to the attached drawings.

BRIEF DESCRIPTION OF THE DRAWINGS

FIG. 5 is a diagram illustrating a reallocation method of a discharge destination according to the first embodiment.

DESCRIPTION OF THE EMBODIMENTS

<Configuration Diagram of Image Forming Apparatus>

Figure 1:
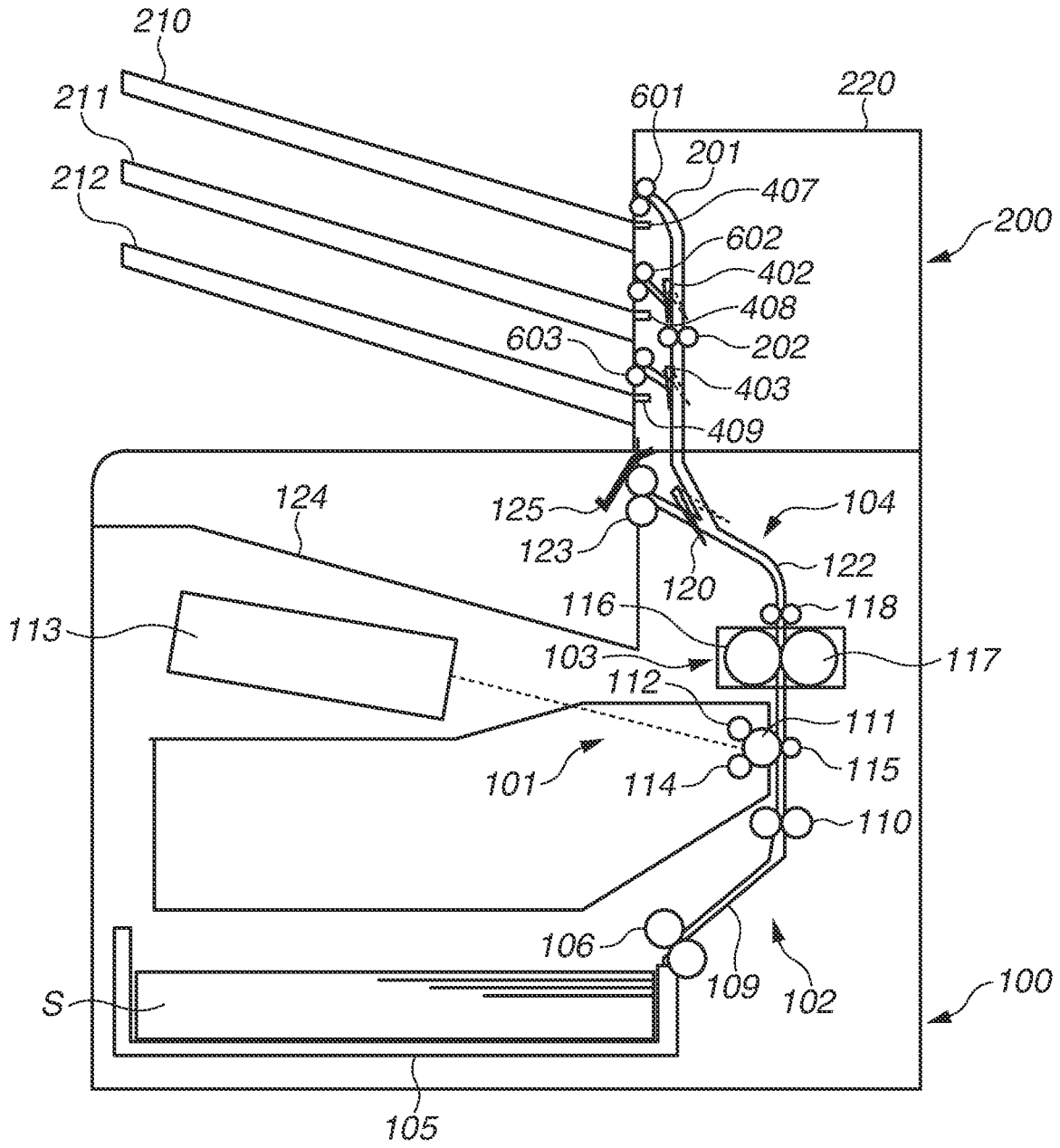
FIG. 1 is a diagram illustrating a configuration of an image forming apparatus and a sheet sorting device according to the first embodiment.

FIG. 1 is a diagram schematically illustrating a configuration of an image forming apparatus according to the first embodiment of the present disclosure. In the present embodiment, a laser beam printer 100 (hereinafter, called as "printer 100") is taken as an example of the image forming apparatus.

As illustrated in FIG. 1, the printer 100 includes an image forming unit 101, a feeding unit 102 which feeds a sheet (recording material) S such as paper to the image forming unit 101, a fixing unit 103 which fixes an image formed on the sheet S by the image forming unit 101, and a discharge unit 104. Further, a sheet sorting device 200 which receives from the printer 100 the sheet S on which an image is formed and sorts the sheet S is disposed on the upper side of the printer 100.

The image forming unit 101 includes a photosensitive drum 111 which rotates in a counterclockwise direction in FIG. 1, a charging roller 112 which charges a surface of the photosensitive drum 111, and an exposure device 113 which irradiates the charged photosensitive drum 111 with light to form an electrostatic latent image on the photosensitive drum 111. The image forming unit 101 further includes a development device 114 which forms a toner image on the photosensitive drum 111 by developing an electrostatic latent image with toner and a transfer roller 115 which transfers the toner image onto the sheet S conveyed thereto. Through the above-described image forming processing, the image forming unit 101 forms a toner image on the sheet S. The fixing unit 103 includes a fixing roller 116 and a pressure roller 117 that forms a fixing nip portion with the fixing roller 116, and fixes the transferred toner image on the sheet S by applying heat and pressure thereto.

The feeding unit 102 includes a cassette 105 in which a plurality of sheets S used for image formation is stored in a stacked state, a feeding roller 106, a conveyance guide 109, and a registration roller 110. The discharge unit 104 includes a switching member 120, a fixing discharge roller 118, a discharge guide 122, a discharge roller 123, a discharge tray 124, and a full-stacked state detection flag 125. When a full-stacked state of the discharge tray 124 is detected by the full-stacked state detection flag 125, the printer 100 does not discharge sheets to the discharge tray 124 until the sheets S discharged onto the discharge tray 124 are removed.

In addition, the switching member 120 can be moved by an actuator (not illustrated) to a position indicated by a solid line where the switching member 120 guides the sheet S after image formation to the sheet sorting device 200 and a position indicated by a dashed line where the switching member 120 guides the sheet S to the discharge tray 124.

<Configuration Diagram of Sheet Sorting Device>

Next, the sheet sorting device 200 according to the present embodiment will be described with reference to FIG. 1. A conveyance guide 201 guides a sheet S conveyed from the printer 100. The conveyance guide 201 includes a plurality of branched portions, and discharge trays 210, 211, and 212 are arranged at respective ends of the branched portions. The sheet S is discharged to any one of the discharge trays 210, 211, and 212 through a conveyance roller pair 202, and discharge roller pairs 601, 602, and 603. The discharge trays 210, 211, and 212 are optionally attached to and detached from an apparatus main body (also referred to as "housing") 220 of the sheet sorting device 200. Here, switching members 402 and 403 can be moved by an actuator (not illustrated) to positions indicated by a solid line and positions indicated by a dashed line in FIG. 1. For example, when the sheet S is to be discharged to the discharge tray 210, the switching members 402 and 403 respectively are moved to the positions indicated by a solid line in FIG. 1. When the sheet S is to be discharged to the discharge tray 211, the switching member 402 is moved to the position indicated by a dashed line in FIG. 1, and the switching member 403 is moved to the position indicated by a solid line in FIG. 1.

Tray detection sensors 407, 408, and 409 respectively detect whether the discharge trays 210, 211, and 212 are detached from the apparatus main body 220. For example, each of the tray detection sensors 407, 408, and 409 is configured of a photo-interrupter, and outputs an OFF signal in a light-transmitting state where the discharge tray 210, 211, or 212 is detached from the apparatus main body 220 so that light emitted from the photo-interrupter is not interrupted thereby. Then, each of the tray detection sensors 407, 408, and 409 outputs an ON signal in a light-interrupting state where the discharge tray 210, 211, or 212 is attached to the apparatus main body 220 so that light emitted from the photo-interrupter is interrupted thereby.

<Block Diagram of Control Unit and Functional Configuration>

Figure 2:
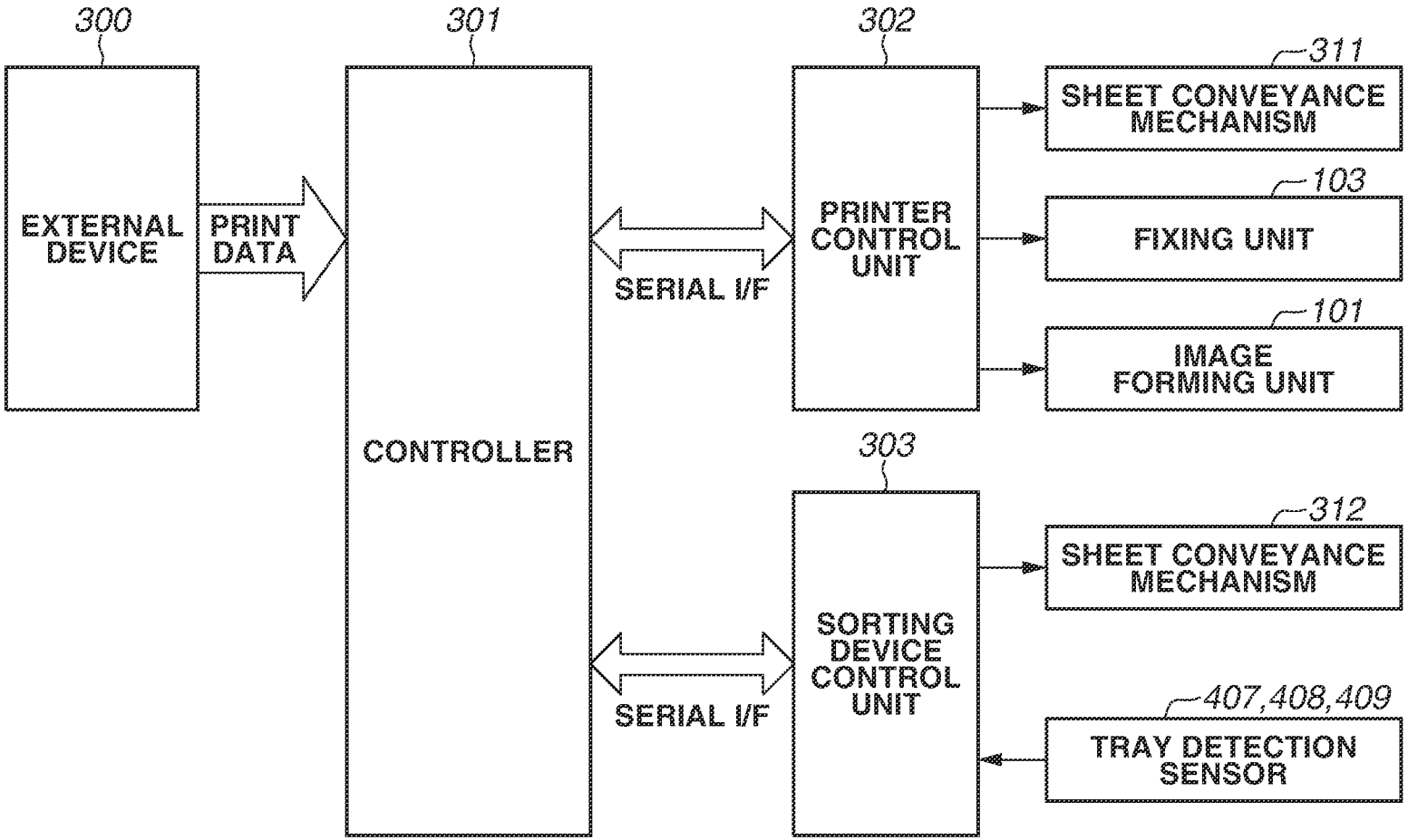
FIG. 2 is a block diagram illustrating a control unit and a functional configuration of the image forming apparatus according to the first embodiment.

FIG. 2 is a block diagram illustrating a functional configuration in the present embodiment. The printer 100 includes control units such as a controller 301, a printer control unit 302 for controlling the printer 100, and a sorting device control unit 303 for controlling the sheet sorting device 200. The controller 301 communicates with an external apparatus 300 such as a host computer to receive print data. Further, the controller 301 specifies a printing condition created from the print data and transmits a printing instruction to the printer control unit 302 via a serial interface (I/F). The printer control unit 302 controls respective mechanisms according to the printing condition received from the controller 301. Specifically, the printer control unit 302 controls a sheet conveyance mechanism 311 configured of the feeding unit 102 and the discharge unit 104 to feed or discharge the sheet S, and controls the image forming unit 101 and the fixing unit 103 to form and fix an image on the sheet S.

Further, the controller 301 specifies a sorting destination of the sheet S to the sorting device control unit 303 via a serial I/F. The sorting device control unit 303 controls respective mechanisms according to the sorting destination received from the controller 301. Specifically, the sorting device control unit 303 controls a sheet conveyance mechanism 312 including the conveyance roller pair 202, the discharge roller pairs 601, 602, and 603, and the switching members 402 and 403 to convey the sheet S on which an image is formed. Further, the sorting device control unit 303 detects the presence or absence of each of the discharge trays 210, 211, and 212 based on a detection result acquired by each of the tray detection sensors 407, 408, and 409.

<Details of Sorting Device Control Unit>

Figure 3:
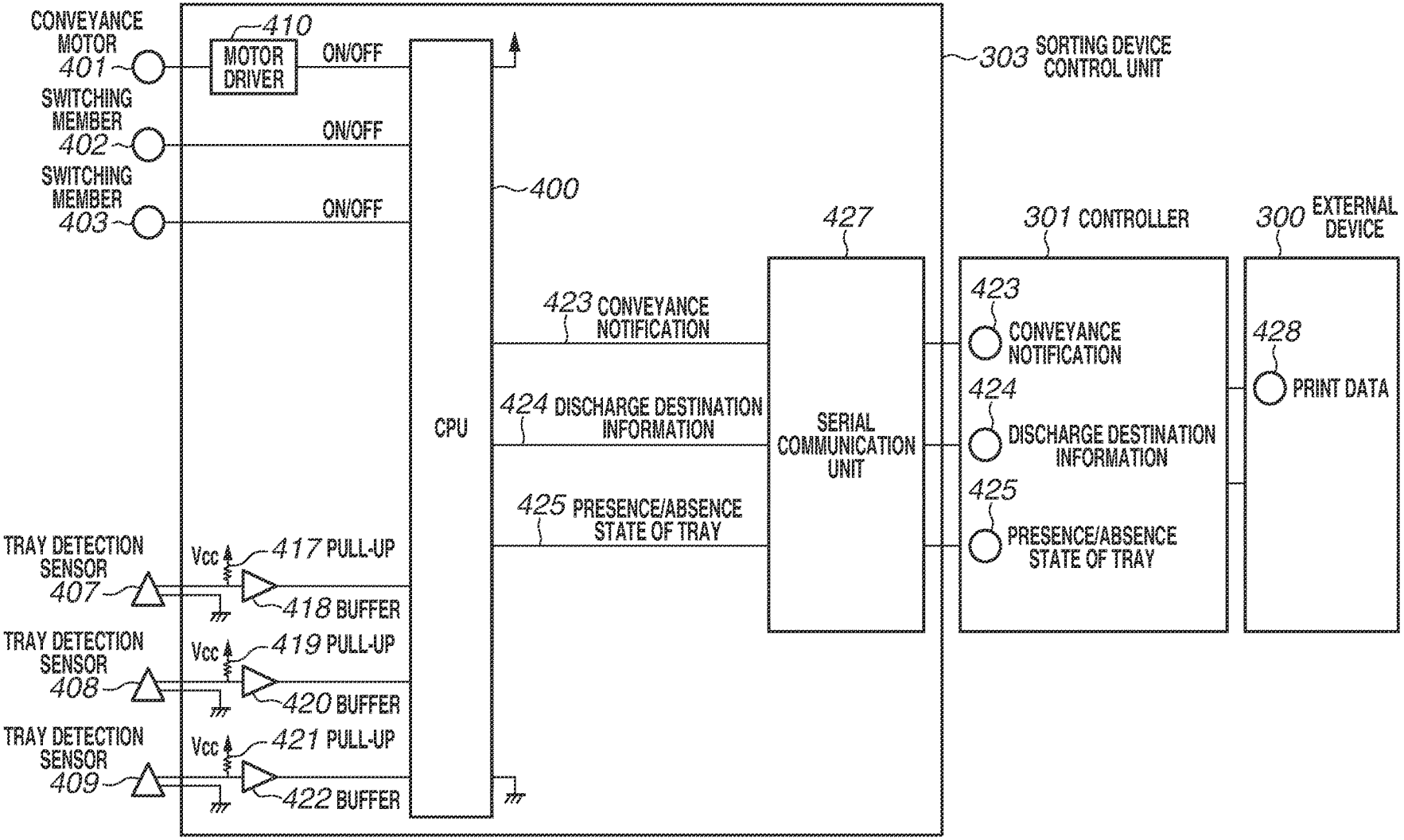
FIG. 3 is a diagram illustrating details of a sorting device control unit according to the first embodiment.

FIG. 3 is a block diagram illustrating details of the sorting device control unit 303 according to the present embodiment. The sorting device control unit 303 includes a central processing unit (CPU) 400, and communicates with the controller 301 via a serial communication unit 427. The serial communication unit 427 connects the CPU 400 and the controller 301 through a plurality of signal lines.

When print data 428 is transmitted to the controller 301 through the external apparatus 300, the controller 301 transmits a conveyance notification signal 423 and discharge destination information 424 to the CPU 400 via the serial communication unit 427. The CPU 400 transmits a tray presence/absence state signal 425 to the controller 301 via the serial communication unit 427.

A motor driver 410 is connected to an output terminal of the CPU 400. The motor driver 410 drives a conveyance motor 401. The conveyance motor 401 rotates to rotate the conveyance roller pair 202 and the discharge roller pairs 601, 602, and 603, so that the sheet S is conveyed to the discharge tray 210, 211, or 212.

An actuator (not illustrated) for switching a position of the switching member 402 is connected to an output terminal of the CPU 400. The switching member 402 is switched to a position indicated by a dashed line in FIG. 1 when the actuator is turned on, so that the sheet S is guided toward the discharge tray 211. The switching member 402 is switched to a position indicated by a solid line in FIG. 1 when the actuator is turned off, so that the sheet S is guided toward the discharge tray 210.

An actuator (not illustrated) for switching a position of the switching member 403 is connected to an output terminal of the CPU 400. The switching member 403 is switched to a position indicated by a dashed line in FIG. 1 when the actuator is turned on, so that the sheet S is guided toward the discharge tray 212. The switching member 403 is switched to a position indicated by a solid line in FIG. 1 when the actuator is turned off, so that the sheet S is guided toward the discharge tray 210 or 211.

The tray detection sensor 407 uses a pullup 417 to input a sensor state (i.e., an ON signal or an OFF signal) to the CPU 400 via a buffer 418. Details of the tray detection sensors 408 and 409 are similar to that of the tray detection sensor 407, so that description thereof will be omitted.

<Description of Operation Executed by Sheet Sorting Device>

Subsequently, an operation executed by the sheet sorting device 200 in the present embodiment will be described with reference to FIGS. 4 and 5. Here, the operation will be described with respect to the case where the discharge tray 211 is detached from the apparatus main body 220 when a sorting destination of a sheet S is set such that a sheet conforming to a preset condition is to be sorted to the discharge tray 211 (predetermined tray).

Figure 4:
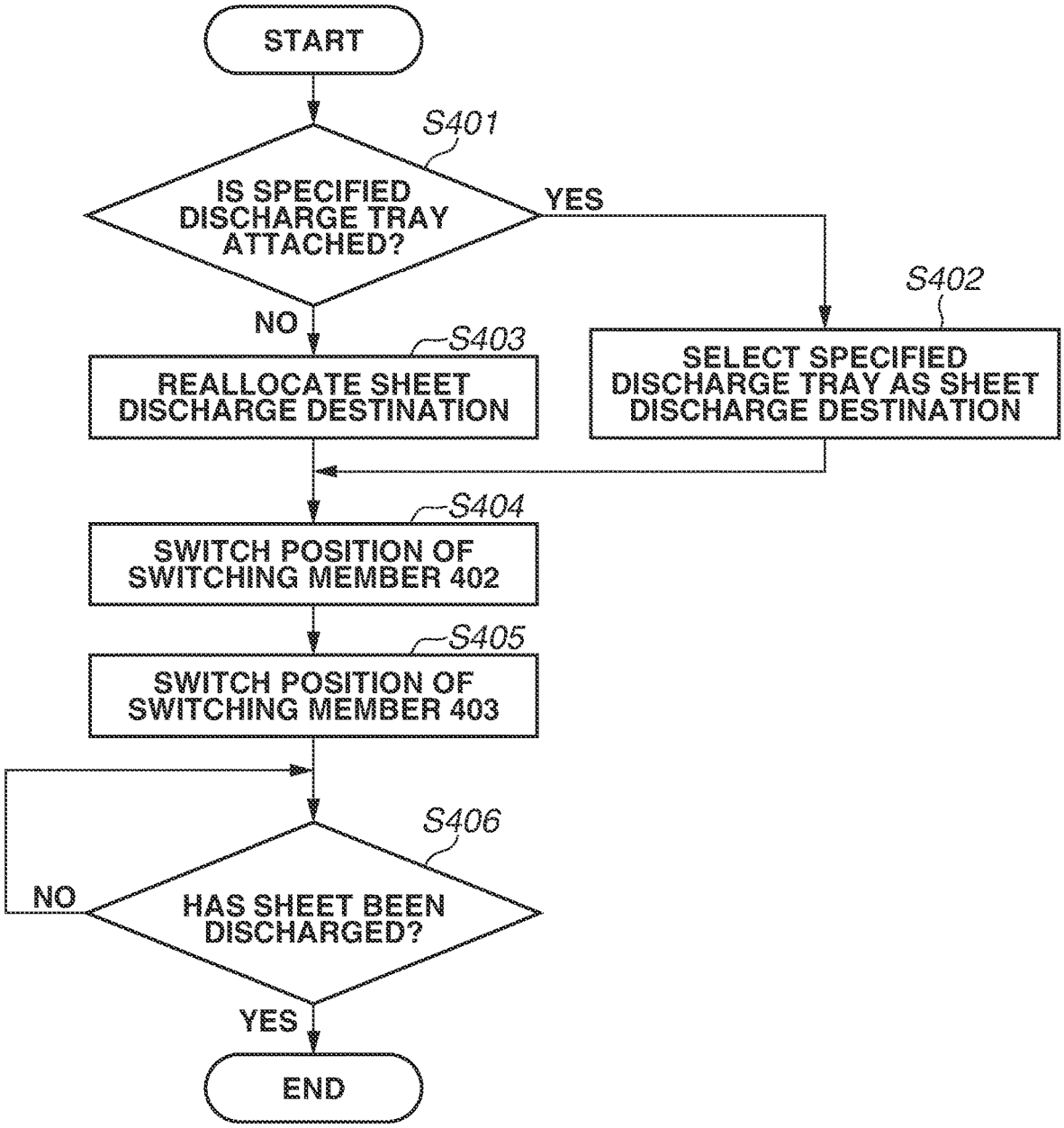
FIG. 4 is an operation flowchart according to the first and the second embodiments.

FIG. 4 is a flowchart according to the present embodiment. The sorting device control unit 303 in FIG. 2 or 3 executes the control in the flowchart in FIG. 4 based on the program stored in a storage unit such as a read only memory (ROM) or a random access memory (RAM).

When the sheet S is conveyed to the sheet sorting device 200, the sorting device control unit 303 receives an instruction from the controller 301. In step S401, the sorting device control unit 303 confirms whether a discharge tray (any one of the discharge trays 210 to 212) specified as a discharge destination of the sheet S by the controller 301 is attached to the apparatus main body 220. In the present embodiment, the operation will be described with respect to the case where the discharge tray 211 is specified as a discharge destination.

If the discharge tray 211 is attached to the apparatus main body 220 (YES in step S401), the processing proceeds to step S402. In step S402, the sorting device control unit 303 selects the discharge tray 211 as a discharge destination of the sheet S. On the other hand, if the discharge tray 211 is detached from the apparatus main body 220 (NO in step S401), the processing proceeds to step S403. In step S403, the sorting device control unit 303 executes processing for reallocating the discharge destination of the sheet S. The reallocation processing will be described below in detail. Thereafter, when the sorting device control unit 303 receives a conveyance instruction of the sheet S from the controller 301, in steps S404 and S405, the sorting device control unit 303 switches the positions of the switching members 402 and 403 to control the sheet S to be conveyed to the selected discharge destination. Thereafter, in step S406, when the sheet S has been discharged (YES in step S406), the sorting device control unit 303 ends the processing.

The reallocation processing of the discharge destination of the sheet S in step S403 will be described with reference to FIG. 5. Each of the tables (A-1), (B-1), and (C-1) in FIG. 5 illustrates a condition for sorting the sheets S to each of the discharge trays 210 to 212, and a state (i.e., a use history, a remaining number of stackable sheets, or a use history/function) of the discharge trays 210 to 212. Each of the tables (A-2), (B-2), and (C-2) in FIG. 5 illustrates a reallocation result of the discharge destination of the sheets S when the discharge tray 211 is detached from the apparatus main body 220. In FIG. 5, the tables (A-1), (B-1), and (C-1) corresponds to the tables (A-2), (B-2), and (C-2) respectively.

In each of the tables (A-1) and (A-2) in FIG. 5, the discharge destination of the sheet S is reallocated based on the use histories of the discharge trays 210 to 212. In the table (A-1) in FIG. 5, the sheets S of the users A, B, and C are set to be discharged to the discharge trays 210, 211, and 212, respectively. In other words, the sheet S on which an image is formed according to an image forming instruction issued by the user B is discharged to the discharge tray 211. In the table (A-1) in FIG. 5, only the user A has a use history, whereas the users B and C do not have use histories. It is assumed that the discharge tray 211 is detached from the apparatus main body 220 in the above-described state. If an image forming instruction is issued by the user B, the sorting device control unit 303 reallocates the discharge destination of the sheet S for the user B based on the use states of the discharge trays 210 and 212 other than the discharge tray 211. The sorting device control unit 303 sets the discharge tray 212 as the discharge destination of the sheet S for the user B such that the sheet S for the user B is not mixed with the sheets S for the user A who has the use history. In other words, the sorting device control unit 303 sets the discharge destination of the sheet S for the user B to a discharge tray with no use history.

In each of the tables (B-1) and (B-2) in FIG. 5, the discharge destination of the sheet S is reallocated based on the remaining number of sheets stackable on each of the discharge trays 210 to 212. In the table (B-1) in FIG. 5, a sorting condition of the sheet S before detaching the discharge tray 211 is similar to that of the table (A-1) in FIG. 5. In the table (B-1) in FIG. 5, the remaining numbers of sheets S stackable on the discharge trays 210, 211, and 212 are 120 sheets, 200 sheets, and 200 sheets, respectively. At this time, it is assumed that the user C detaches the discharge tray 211 from the apparatus main body 220 in order to execute mass-printing. Because the discharge tray 211 is detached, a sheet stacking space of the discharge tray 212 is increased, so that 500 sheets S can be stacked on the discharge tray 212. Then, when the user C issues an instruction for executing mass-printing of 470 sheets S, the remaining number of sheets stackable on the discharge tray 212 becomes 30 sheets as illustrated in the table (B-2) in FIG. 5. Further, in a case where the user B issues an image forming instruction after the user C, the sorting device control unit 303 sets a discharge tray having the greater remaining number of stackable sheets from among the discharge trays 210 and 212 other than the discharge tray 211 as the discharge destination of the sheet S for the user B. In other words, the sorting device control unit 303 selects the discharge tray 210 on which 120 sheets can be stacked.

In addition, after the discharge tray 211 has been detached therefrom, the discharge tray 212 has the greatest remaining number of stackable sheets until the user C issues a mass-printing instruction of 470 sheets S. Therefore, the sorting device control unit 303 sets the discharge tray 212 as the discharge destination of the sheet S for the user B.

In each of the tables (C-1) and (C-2) in FIG. 5, the discharge destination of the sheet S is reallocated based on a function included in the discharge tray. In the table (C-1) in FIG. 5, a sorting condition of the sheet S before detaching the discharge tray 211 is similar to that of the table (A-1) in FIG. 5. In the table (C-1) in FIG. 5, the discharge tray 210 includes an offset function. The offset function refers to a function of stacking the discharged sheets S while shifting the sheets S in a main scanning direction or a sub-scanning direction in units of copy number. In other words, positions of the sheets S to be discharged are relatively shifted to each other, so that the user can easily find a sectioning position between the stacked sheets S. In the table (C-1) in FIG. 5, all of the discharge trays 210 to 212 have use histories. In this state, it is assumed that the discharge tray 211 is detached from the apparatus main body 220. Then, in a case where the user B issues an image forming instruction, the sorting device control unit 303 selects the discharge tray 210 as a discharge destination of the sheets S for the user B in order to prevent the sheets S from being mixed with the sheets S for the other users because both of the discharge trays 210 and 212 have use histories. In other words, the sorting device control unit 303 sets a discharge tray having the offset function as the discharge destination for the user B.

As described above, according to the present embodiment, usability can be refined with respect to the case where the discharge tray is detached from the apparatus main body.

In the present embodiment, although a method of reallocating the discharge destination of the sheet S based on a state such as a use history, a remaining number of stackable sheets, or a use history/function has been described, the embodiment is not limited thereto. For example, the discharge destination of the sheet S can be reallocated based on other information such as the average number of printed sheets. Further, in a case where the detached discharge tray is attached again, setting of the discharge destination of the sheet S is returned to the previous setting.

In the first embodiment, a method of reallocating the discharge destination of the sheet S based on the use history, the remaining number of stackable sheets, or the use history/ function of each discharge tray has been described. In the second embodiment, a method of reallocating a discharge destination of the sheet S, which is executed in a configuration in which the presence or absence of the sheets S stacked on each of the discharge trays is recognized, will be described. A configuration different from the configuration described in the first embodiment will be described because a main portion thereof is similar to that of the first embodiment.

<Configuration Diagram of Sheet Sorting Device>

Figure 6:
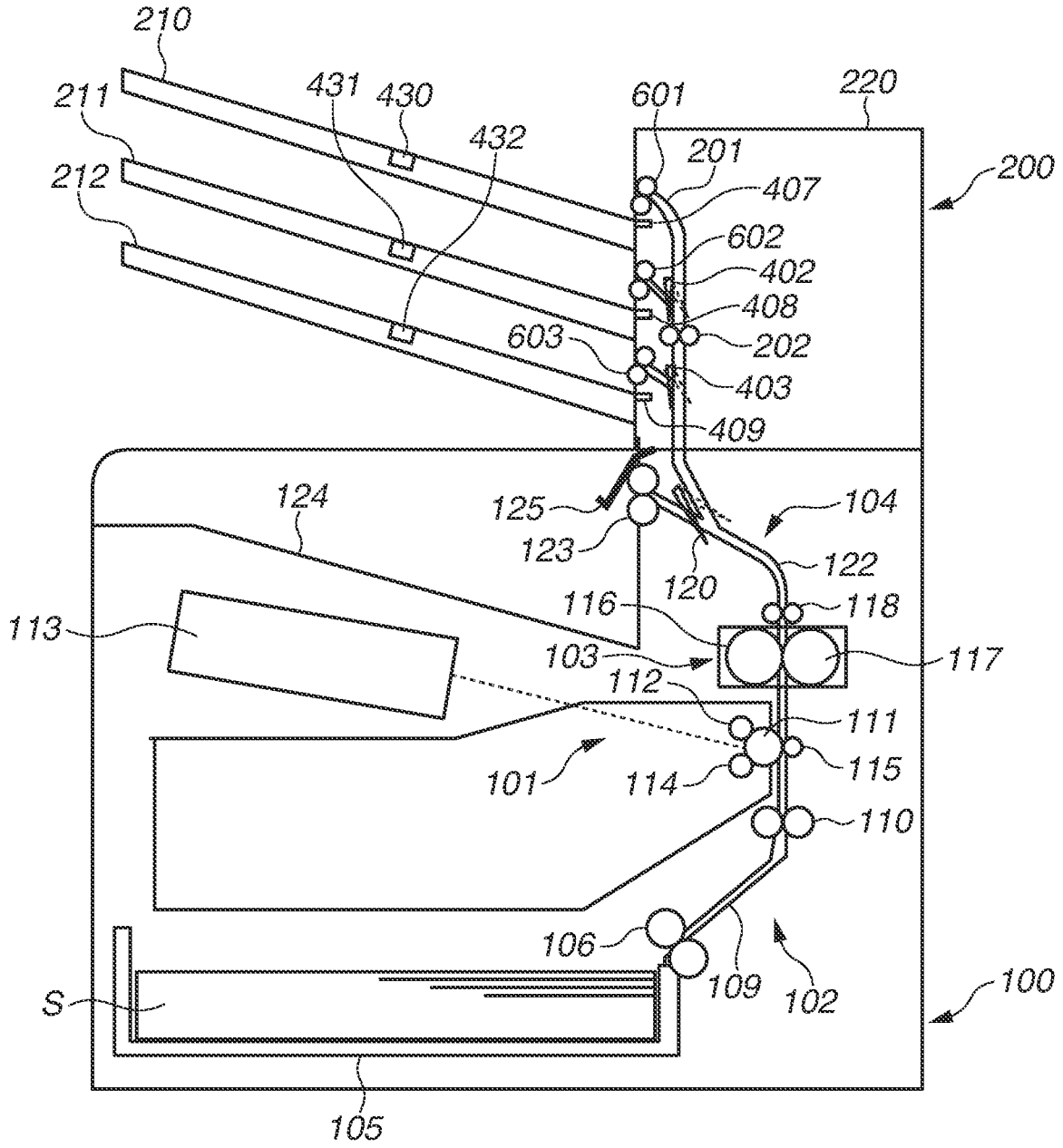
FIG. 6 is a diagram illustrating a configuration of an image forming apparatus and a sheet sorting device according to the second embodiment.

The sheet sorting device 200 in the present embodiment will be described with reference to FIG. 6. A configuration is different from that of the first embodiment in that the sheet sorting device 200 includes sheet detection sensors 430, 431, and 432. The sheet detection sensors 430, 431, and 432 respectively detect the presence or absence of the sheets S stacked on the discharge trays 210, 211, and 212. For example, each of the sheet detection sensors 430, 431, and 432 is configured of a photo-interrupter, and outputs an OFF signal in a light-transmitting state where the sheets S are not stacked on the discharge tray 210, 211, or 212 so that light emitted from the photo-interrupter is not interrupted by a flag (not illustrated). Then, each of the sheet detection sensors 430, 431, and 432 outputs an ON signal in a light-interrupting state where the sheets S are stacked on the discharge tray 210, 211, or 212 so that light emitted from the photo-interrupter is interrupted by the flag (not illustrated).

<Block Diagram of Control Unit and Functional Configuration>

Figure 7:
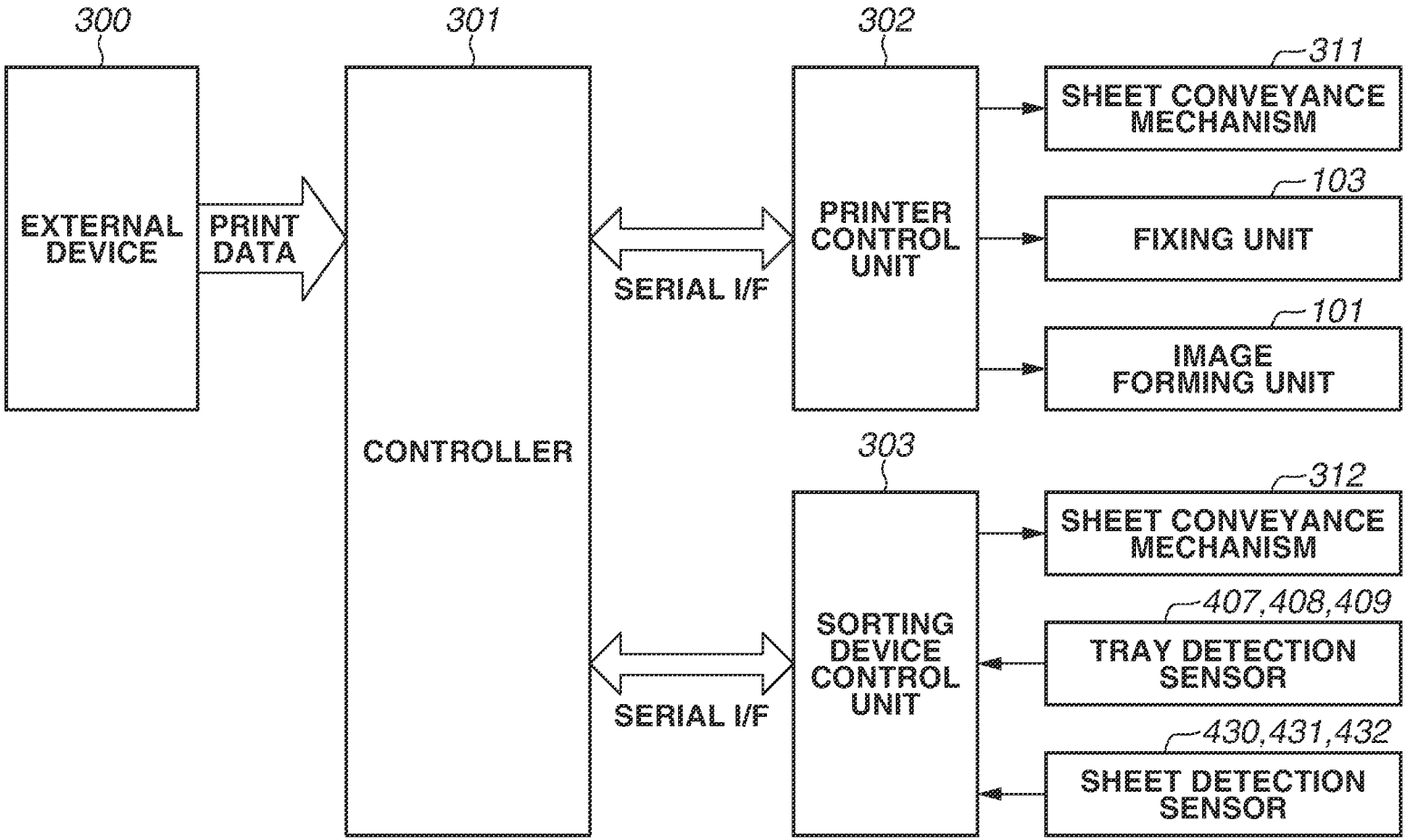
FIG. 7 is a block diagram illustrating a control unit and a functional configuration of the image forming apparatus according to the second embodiment.

FIG. 7 is a block diagram illustrating a functional configuration according to the present embodiment. A configuration is different from that of the first embodiment in that the sheet sorting device 200 includes the sheet detection sensors 430, 431, and 432. The sorting device control unit 303 detects the presence or absence of the sheets S stacked on each of the discharge trays 210, 211, and 212 based on a detection result acquired by the corresponding one of the sheet detection sensors 430, 431, and 432.

<Description of Operation Executed by Sheet Sorting Device>

Figure 8:
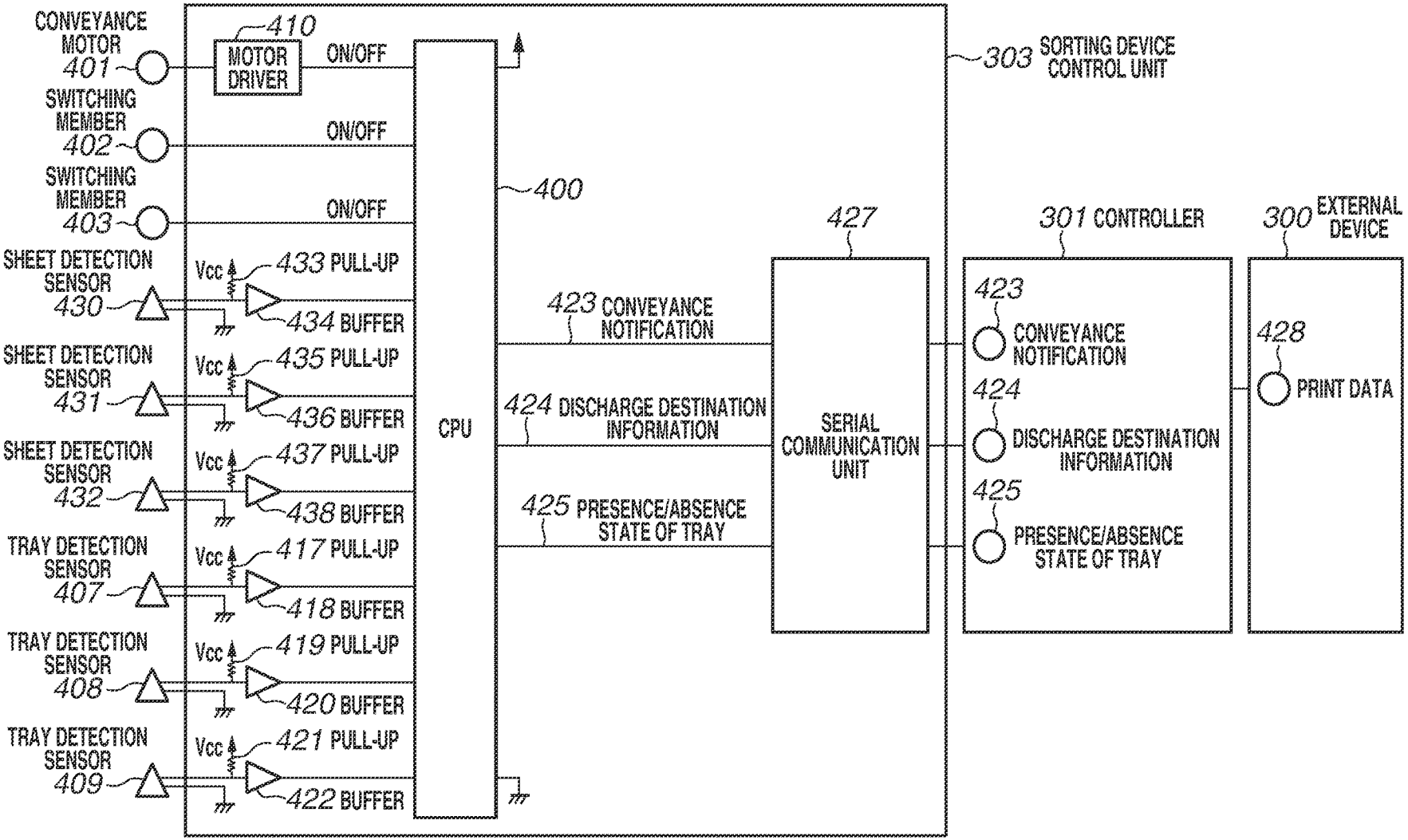
FIG. 8 is a diagram illustrating details of a sorting device control unit according to the second embodiment.

FIG. 8 is a block diagram illustrating details of the sorting device control unit 303 according to the present embodiment. The sheet detection sensor 430 uses a pullup 433 to input a sensor state (i.e., an ON signal or an OFF signal) to the CPU 400 via a buffer 434. Details of the sheet detection sensors 431 and 432 are similar to that of the sheet detection sensor 430, so the description thereof will be omitted.

<Description of Operation Executed by Sheet Sorting Device>

Next, an operation of the sheet sorting device 200 in the present embodiment will be described. A reallocation method of a discharge destination of the sheet S is different from the method described in the first embodiment although a flowchart is similar to that of the first embodiment. In the present embodiment, as a state of each of the discharge trays 210 to 212, attention is given to the presence or absence of the sheets S discharged to each of the discharge trays 210 to 212.

As described above, the sorting device control unit 303 can determine whether the sheets S are stacked on each of the discharge trays 210, 211, and 212 based on the detection result acquired by the corresponding one of the sheet detection sensors 430, 431, and 432. Here, as illustrated in FIG. 5 described in the first embodiment, it is assumed that the discharge tray 211 is detached from the apparatus main body 220 in a state where the discharge destination of the sheet S is previously set such that the sheet S for the user B is conveyed to the discharge tray 211. The sorting device control unit 303 selects a discharge tray on which the sheets S are not stacked, as a discharge destination of the sheets S for the user B, from among the discharge trays 210 and 212. With the configuration, the sheets S for the user B is prevented from being mixed with the sheets S for the other users. Further, in a case where the detached discharge tray is attached again, setting of the discharge destination of the sheet S is returned to the previous setting.

Further, in the above-described first and the second embodiments, methods of reallocating a discharge destination of the sheet S by independently using the information such as a use history, a remaining number of stackable sheets, a use history/function, or the presence or absence of the sheet S has been described. However, a similar effect can be acquired even if a discharge destination is determined by using a combination of the above-described information.

For example, in a case where the sheet detection sensor detected that one user promptly collected the sheet S after completion of printing in the past, the uppermost discharge tray can be reallocated as a discharge destination of the sheets S even if the sheets S are stacked on the uppermost discharge tray.

Further, in the above-described first and the second embodiments, although all of the discharge trays 210, 211, and 212 can be detached from the apparatus main body 220, the configuration is not limited thereto. The configuration may be such that only the discharge tray 211 can be detached while the discharge trays 210 and 212 cannot be detached. In other words, the configuration may be such that at least one discharge tray can be detached from the apparatus main body 220.

Furthermore, in the above-described first and the second embodiments, the printer control unit 302 and the sorting device control unit 303 are separately provided. However, only the printer control unit 302 may be provided. In this case, the printer control unit 302 may control the sheet sorting device 200.

Further, in the above-described first and the second embodiments, the sheet sorting device 200 may be detachably attached to the printer 100, or may be integrally fixed to the printer 100.

Furthermore, in the above-described first and the second embodiments, although three discharge trays 210, 211, and 212 are arranged thereon, the number of discharge trays is not limited to three. The number of discharge trays may be set according to the environment where the sheet sorting device 200 is used, the number of users who share the image forming apparatus, or the specification of the sheet sorting device 200.

Further, in the above-described first and the second embodiments, although a laser beam printer has been taken as an example, the image forming apparatus to which the present disclosure is applied is not limited thereto, and the image forming apparatus may be a printer of another printing method such as an ink jet printer, or may be a copying machine.

While the present disclosure has been described with reference to embodiments, it is to be understood that the disclosure is not limited to the disclosed embodiments. The scopes of the following claim terms are to be accorded their broadest interpretation to encompass all such modifications and equivalent structures and functions.

This application claims the benefit of Japanese Patent Application No. 2017-246679, filed Dec. 22, 2017, which is hereby incorporated by reference herein in its entirety.

What is claimed is:

1. A sheet sorting device comprising:

three or more trays including at least a first tray, a second tray, and a third tray, wherein at least the first tray is detachable from an apparatus main body;

a discharge unit configured to discharge a sheet to any one of the three or more trays;

a tray detection unit configured to detect that a predetermined tray among the three or more trays is detached from the apparatus main body; and a control unit configured to change a sheet discharge destination from the first tray in a case where the tray detection unit detects that, as the predetermined tray, the first tray is detached, wherein, in a case where the control unit changes the sheet discharge destination from the first tray to the second tray, wherein a first sheet discharged to the second tray before detachment of the first tray from the apparatus main body and a second sheet discharged to the second tray after the detachment of the first tray from the apparatus main body are discharged in an offset state such that relative positions of the first sheet and the second sheet on the second tray are shifted from each other, and wherein, by changing the sheet discharge destination from the first tray to the second tray, the control unit performs control so that the second sheet that is discharged to the second tray under the first sorting condition is not mixed with a third sheet that is discharged to the third tray under a third sorting condition that is different from the second sorting condition.

2. The sheet sorting device according to claim 1, wherein the first tray, the second tray, and the third tray are arranged in a vertical direction, and wherein the control unit is configured to change the sheet discharge destination from the first tray to the second tray, where the second tray is located in a position one step higher than the first tray in the vertical direction.

3. An image forming apparatus comprising:

an image forming unit configured to form an image on a sheet;

three or more trays including at least a first tray, a second tray, and a third tray, wherein at least the first tray is detachable from an apparatus main body;

a discharge unit configured to a discharge, to any one of the three or more trays, the sheet, on which the image is formed by the image forming unit;

a tray detection unit configured to detect that a predetermined tray among the three or more trays is detached from the apparatus main body; and a control unit configured to change a sheet discharge destination from the first tray in a case where the tray detection unit detects that, as the predetermined tray, the first tray is detached, wherein, in a case where the control unit changes the sheet discharge destination from the first tray to the second tray, the control unit keeps a first sorting condition set for the first tray as a second sorting condition for the second tray, wherein a first sheet discharged to the second tray before detachment of the first tray from the apparatus main body and a second sheet discharged to the second tray after the detachment of the first tray from the apparatus main body are discharged in an offset state such that relative positions of the first sheet and the second sheet on the second tray are shifted from each other, and wherein, by changing the sheet discharge destination from the first tray to the second tray, the control unit performs control so that the second sheet that is discharged to the second tray under the first sorting condition is not mixed with a third sheet that is discharged to the second tray under the second sorting condition.

4. The image forming apparatus according to claim 3, wherein the first tray, the second tray, and the third tray are arranged in a vertical direction, and wherein the control unit is configured to change the sheet discharge destination from the first tray to the second tray, where the second tray is located in a position one step higher than the first tray in the vertical direction.

* * * * *